US005638725A

United States Patent [19]

Rosier

[11] Patent Number: 5,638,725

[45] Date of Patent: Jun. 17, 1997

[54] END CAP ASSEMBLY FOR A FASTENER INSTALLATION TOOL

[75] Inventor: Hendrick E. Rosier, Port Ewen, N.Y.

[73] Assignee: Huck International, Kingston, N.Y.

[21] Appl. No.: 623,896

[22] Filed: Mar. 26, 1996

[51] Int. Cl.[6] ..... B24B 13/00

[52] U.S. Cl. ..... 81/54; 81/57.44

[58] Field of Search ..... 81/52, 54, 57.39, 81/57.44; 173/164; 72/391

[56] References Cited

U.S. PATENT DOCUMENTS

| | | | |
|---|---|---|---|
| 4,924,691 | 5/1990 | Summerlin et al. | 72/391 |
| 5,263,388 | 11/1993 | Beuke | 81/57.44 X |

OTHER PUBLICATIONS

"Nose Assembly–16MG," Huck International, Inc. blueprints (three pages).

"Nose Assembly ⅝ MG," Huck International, Inc. blueprints (three pages).

"Nose Assembly–12 BOM," Huck International, Inc. blueprints (three pages).

"Nose Assembly–28 C50L," Huck International, Inc. blueprints (three pages).

"Nose Assembly–16 C50L," Huck International, Inc. blueprints (three pages).

*Primary Examiner*—James G. Smith

*Attorney, Agent, or Firm*—Cushman Darby & Cushman IP Group of Pillsbury Madison & Sutro, LLP; Ronald L. Lyons, Esq.

[57] ABSTRACT

An end cap assembly for a fastener installation tool is shown. The end cap assembly includes an end cap received within a housing of the fastener installation tool. The end cap assembly also includes a protective cover plate positioned to cover the joint between the end cap and the housing. The end cap assembly further includes a lock for preventing the end cap from disengaging the housing when the end cap is positioned within the housing. The end cap is configured with a countersink and corresponding driver to facilitate removal of the end cap from the housing of the fastener installation tool even if the housing has been deformed.

20 Claims, 3 Drawing Sheets

END CAP ASSEMBLY FOR A FASTENER INSTALLATION TOOL

BACKGROUND

1. The Field of the Invention

The present invention is related to an end cap assembly for a fastener installation tool. More particularly, the present invention is related to an end cap assembly which includes a protective cover plate for protecting the joint between the end cap and the housing of the fastener installation tool and which provides a reliable means for removing the end cap.

2. Technical Background

Since the industrial revolution, rivets and other types of fasteners have been used for attaching two or more work pieces together in industrial or other applications. Such fasteners are used to assemble a wide variety of articles from jeans to railroad box cars. These fasteners range in size and load bearing capacity depending upon their application.

The size of the fastener installation tool varies with the characteristics of the fastener. Fastener installation tools are often hydraulic or pneumatic. Generally, hydraulic and pneumatic tools have a piston chamber and piston assembly which operates under hydraulic or pneumatic pressure. Access to this chamber is necessary to repair the piston assembly or otherwise access the internal workings of the tool. Thus, most hydraulic and pneumatic fastener tools have housings with removable end caps which allow such access.

When these fastener installation tools are used in heavy industrial applications, they are generally subject to rigorous use in unfriendly environments. For example, tools of this type are used in such places as railroad yards and shipping yards. Additionally, these heavy industrial uses require larger fasteners or fasteners with greater holding capacities. In either case, the installation tools for these fasteners are generally larger and heavier and are susceptible to being dropped. Thus, these installation tools for industrial fasteners may often be dropped from relatively high places and are otherwise subjected to extreme wear and tear during average use.

A common problem for these tools is that the base of the piston chamber housing endures substantial plastic deformation, making it difficult if not impossible to remove the end cap from the tool. For example, if the tool is repeatedly dropped, the joint between the end cap and the housing may become "peened over" making removal of the end cap virtually impossible.

Conventional end caps are difficult to remove even if the joint or the housing is only slightly damaged because most conventional end caps are not configured with a place to attach a tool for applying a sufficient removal torque. For example, many end caps are flat with a circular perimeter. Tools used to remove these conventional end caps often slip off these end caps because secure engagement with the end cap is not possible. The configuration of these end caps may facilitate the initial insertion of the end cap within the housing, but the initial insertion usually involves an undamaged end cap and housing.

Heavy industrial hydraulic and pneumatic tools often generate pressures upwards of 5000 psi in the piston chamber. In many fastener installation tools, this pressure also bears against the end cap. Should the end cap disengage the chamber housing under this kind of pressure, the results could be extremely damaging. Accordingly, the end cap assembly must provide a lock to adequately secure the end cap to the housing. Most fastener installation tools have a locking mechanism for locking the end cap to the housing. However, these locking mechanisms are often inconvenient to access and remove. Still other locking mechanisms are unprotected and susceptible to damaging wear and tear.

From the foregoing, it will be appreciated that it would be an advancement in the art to provide an end cap assembly for a fastener installation tool which provides protection for the joint between the end cap and the housing and the portion of the housing adjacent to the joint. It would be another advancement in the art to provide such an end cap assembly which included means to facilitate the removal of the end cap from the fastener installation tool, even if the housing has become substantially deformed. It would also be an advancement in the art to provide such an end cap assembly which included locking means for securing the end cap to the fastener installation tool that is convenient to access and remove.

Such an end cap assembly for a fastener installation tool is disclosed and claimed herein.

BRIEF SUMMARY AND OBJECTS OF THE INVENTION

The present invention is directed to a novel end cap assembly for sealing the housing of a fastener installation tool. The end cap assembly of the present invention includes an end cap with a threaded exterior surface and a housing configured with a threaded internal surface. The exterior surface of the end cap matingly engages the internal surface of the housing when the end cap is positioned within the housing. In a preferred embodiment, the end cap exterior surface and the internal surface of the housing are cylindrical and the mating engagement of the end cap within the housing forms an annular joint between the end cap and the housing.

The end cap is configured with means to facilitate removal of the end cap from the housing of the fastener installation tool. In a preferred embodiment, the means for removing the end cap from the housing comprises a countersink configured within the end cap and a driver configured to securely engage the countersink. In one preferred embodiment, the internal countersink and the driver are hexagonal. The driver includes an attachment segment extending beyond the countersink when the driver is securely positioned within the countersink. In this configuration, a wrench or other torque applying tool can be positioned about the attachment segment of the driver while the driver is securely within the countersink to thereby permit a torque applied to the driver to be transferred to the end cap. Accordingly, the end cap can be reliably removed from the housing of the fastener installation tool even if the housing has been deformed.

The end cap assembly includes a locking means for preventing the end cap from disengaging the housing when the end cap is positioned within the housing. In one embodiment, the locking means consists of a plurality of end cap scallops configured within the end cap and a housing scallop configured within the housing. In a preferred embodiment, the end cap assembly includes six equally spaced end cap scallops. The end cap can be positioned within the housing such that one of the end cap scallops aligns with the housing scallop. The aligned scallops form a locking cavity in which a button can be placed, thereby preventing the end cap from rotational movement relative to the housing.

In a preferred embodiment, the button is configured to fit closely within the locking cavity. Both the button and the locking cavity are substantially cylindrical. The button includes an internally tapped hole to facilitate removal of the button from the locking cavity.

The end cap assembly also includes a cover plate positioned to cover the joint between the end cap and the housing and a portion of the housing adjacent the joint. The cover plate covers the button and maintains the button within the locking cavity. Thus, the locking means is easily accessible as well as being easily removable.

In one preferred embodiment, the cover plate is substantially planar and protects the portion of the housing where the end cap is inserted against deformation. Thus, the housing is less likely to "peen over" the end cap which would make removal of the end cap very difficult. The cover plate also protects the joint from corrosive or other damaging particles which may enter the otherwise unprotected joint and interfere with the threaded engagement of the end cap with the housing.

The cover plate is preferably annular and positionable about a neck of the end cap. The end cap neck prevents the cover plate from transverse movement relative to the end cap. This configuration helps maintain the cover plate aligned with and covering the joint between the end cap and the housing.

The end cap assembly includes retention means for helping to maintain the cover plate in position over the joint. In one embodiment, the retention means includes a notch configured within the end cap neck and a retention ring positioned within the notch. In a preferred embodiment, the retention ring is a removable split ring. When the end cap is positioned within the housing and the cover plate is positioned about the neck and over the joint between the end cap and the housing, a portion of the retention ring is received within the notch. The remaining portion forms a flange which engages the cover plate thereby preventing the cover plate from axial movement with respect to the end cap.

From the foregoing, it will be appreciated that the present invention provides an end cap assembly for a fastener installation tool which protects the joint between the end cap and the housing, and the portion of the housing adjacent the joint, with a protective cover plate thereby preventing the housing from deforming or peening over the end cap. The present invention also provides an end cap assembly which is configured to facilitate the removal of the end cap from the fastener installation tool, even if the joint or the housing adjacent the joint has become damaged. Finally, the present invention provides an end cap assembly with a lock for securing the end cap to the fastener installation tool which can be conveniently accessed and removed.

These and other advantages of the present invention will become more fully apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
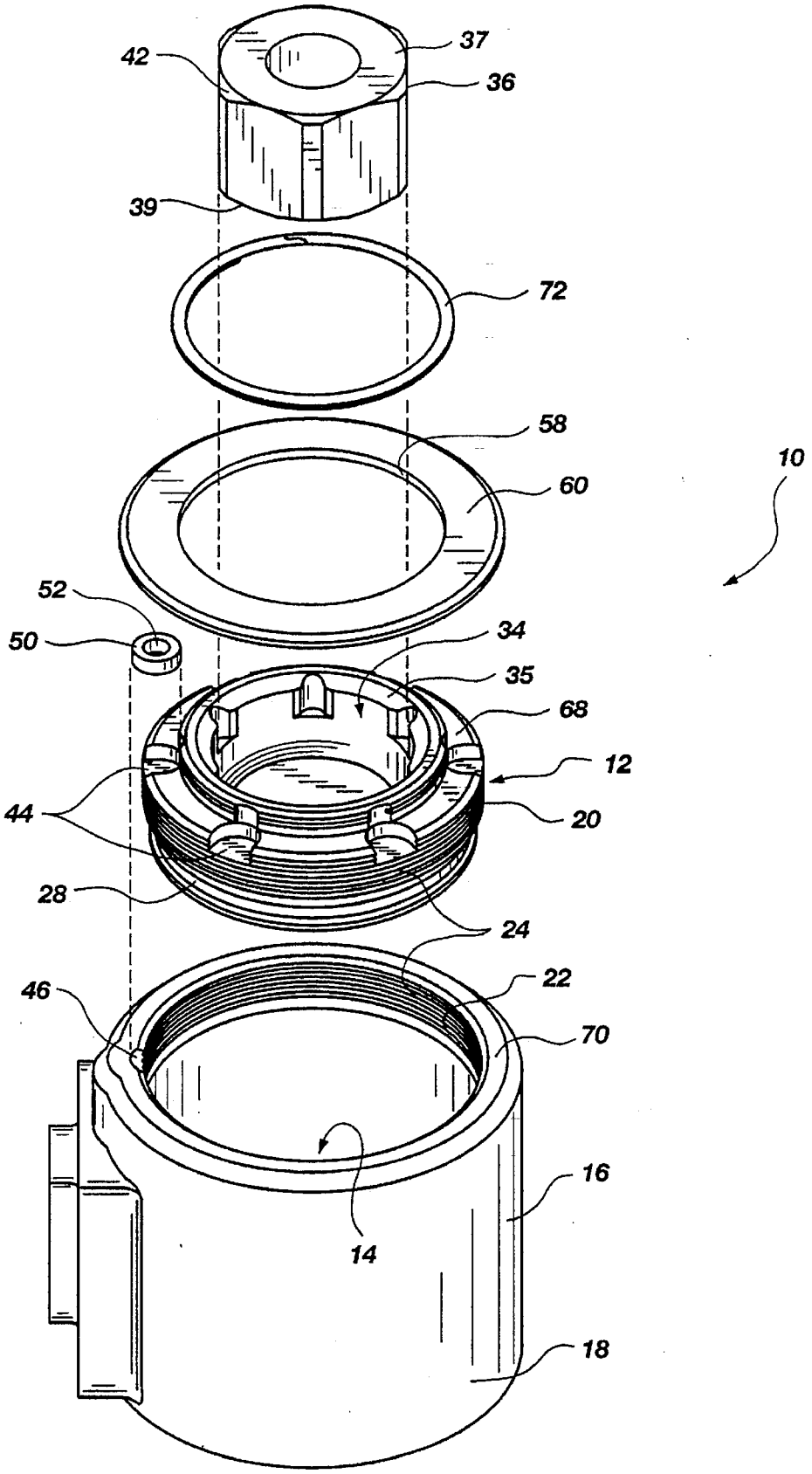
FIG. 1 is an exploded perspective view of one embodiment of the end cap assembly of the present invention.

Reference is now made to the figures wherein like parts are referred to by like numerals throughout. With particular reference to FIG. 1, an end cap assembly according to the present invention is generally designated at 10.

The end cap assembly 10 includes an end cap 12 and a chamber 14 configured within a housing 16 of a fastener installation tool 18. The end cap 12 has an exterior surface 20 which engages an internal surface 22 of the housing 16 such that the end cap 12 may be received and retained within the housing 16. In the preferred embodiment of FIG. 1, the exterior surface 20 of the end cap 12 and the internal surface 22 of the housing 16 are cylindrical, with at least a portion of the exterior surface 20 and a portion of the internal surface 22 being configured with corresponding threads 24. In this preferred embodiment, the end cap 12 may be screwed into the housing 16 such that the exterior surface 20 of the end cap 12 matingly engages the internal surface 22 of the housing 16. One of skill in the art of hydraulic and pneumatic tools will appreciate that there may be alternative ways of threading the housing 16 and end cap 12 to seal the housing 16 of the fastener installation tool 18 with an end cap 12. These ways may be dictated by the amount of hydraulic or pneumatic pressure acting within the housing 16 against the end cap 12.

Figure 2:
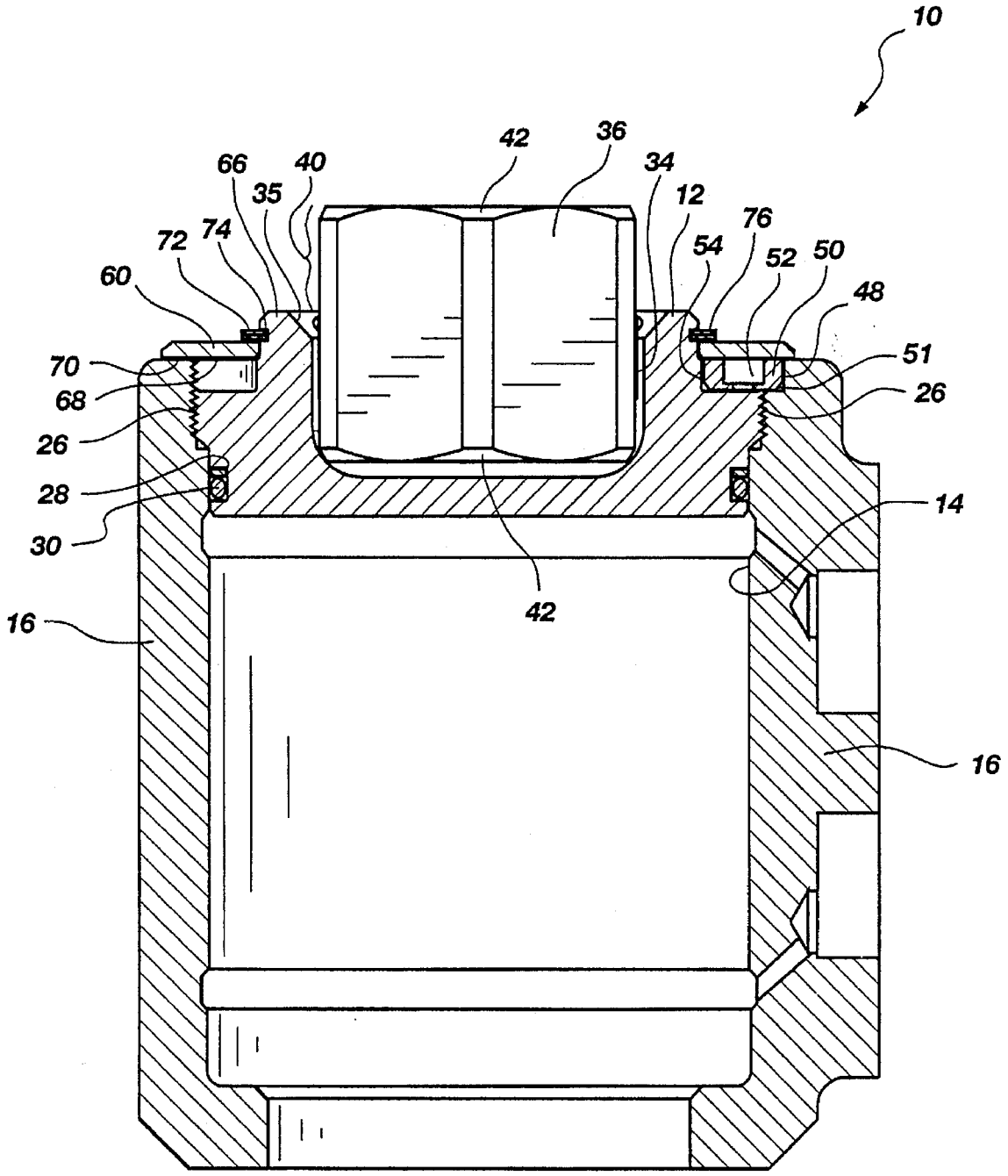
FIG. 2 is a longitudinal cross-section of the end cap assembly of FIG. 1 with the driver positioned in engagement with the end cap countersink.

As can best be seen with reference to FIG. 2, the positioning of the end cap 12 within the housing 16 creates a joint 26 between the end cap 12 and the housing 16. Because the end cap 12 and the housing 16 are cylindrical, the joint 26 is annular.

Referring again to FIG. 1, the end cap assembly 10 also includes means for removing the end cap 12 from the housing 16 of the fastener installation tool 18. In this preferred embodiment, this removal means comprises a countersink 34 configured within the end cap 12 and a driver 36 configured to securely engage the countersink 34. The countersink 34 and driver 36 are substantially hexagonal. The countersink 34 is configured with a bevelled edge 35 to facilitate the insertion of the driver 36 into the countersink 34.

The driver 36 has a first end 37 and a second end 39. Each end 37, 39 of the driver 36 has a bevelled edge 42 to facilitate insertion of the driver 36 into the countersink 34. The driver 36 is configured such that either edge 37, 39 may be inserted into the countersink 34, thereby making the driver 36 substantially orientation independent with respect to the countersink 34. As can best be seen with reference to FIG. 2, the driver 36 has an attachment segment 40 which extends beyond the countersink 34 when the driver 36 is positioned within the countersink 34. In this configuration, the driver 36 can be placed within the countersink 34 and a wrench or other torque applying tool can be positioned about the attachment segment 40 of the driver 36 while the driver 36 is securely positioned within the countersink 34. Thus, torque applied to the driver 36 is transferred to the end cap 12 to facilitate removal of the end cap 12 from the housing 16.

It will be appreciated by those of skill in the art that the internal countersink 34 can be configured in a number of shapes to practice the teachings of this invention. It is important that whatever the shape of the countersink 34, the driver must securely fit within the countersink 34 such that a torque applied to the driver 36 is transferred to the end cap 12. The hexagonal shape of the countersink 34 and driver 36 is preferred because most standard wrenches have hexagonal gripping surfaces.

The removable driver 36 of the present invention enables the driver 36 to be machined to precisely fit the countersink 34 should the external surface of the countersink 34 become damaged or deformed in some way. One of skill in the art will recognize that the means for removing the end cap 12 depends in large part upon the way the end cap 12 is attached to the housing 16 of the fastener installation tool 18.

Referring again to FIG. 1, the end cap assembly 10 includes a locking means for preventing the end cap 12 from vibrating loose or otherwise disengaging the housing 16 when the end cap 12 is positioned within the housing 16. The locking means comprises at least one end cap scallop 44 configured within the end cap 12 and at least one housing scallop 46 configured within the housing 16. It is presently preferred to configure the end cap 12 with six end cap scallops 44 which are equally spaced about a perimeter of the end cap 44. It is also preferred that the end cap assembly 10 includes one housing scallop 46 configured within the housing. The six equally-spaced end cap scallops 44 and the housing scallop 46 are configured to permit one of the end cap scallops 44 to be aligned with the housing scallop 46 when the end cap 12 is positioned within the housing 16.

As can best be seen by reference to FIG. 2, the aligned scallops form a locking cavity 48. The locking means further includes a button 50 which is configured to fit securely within the locking cavity 48. The button 50 substantially conforms to the shape of the locking cavity 48. In the presently preferred embodiment, the locking cavity 48 and button 50 are substantially cylindrical. The button 50 has a bevelled edge 51 to facilitate the positioning of the button 50 within the locking cavity 48.

The locking cavity is defined by cavity walls 54. The button 50 of the preferred embodiment does not extend above the walls 54 of the locking cavity 48. To facilitate removal of the button 50 from the locking cavity 48, the button 50 is preferably configured with an internally tapped hole 52. The internally tapped hole 52 provides an unobstructed internal surface which can be used to remove the button 50 from the locking cavity 48.

Figure 3:
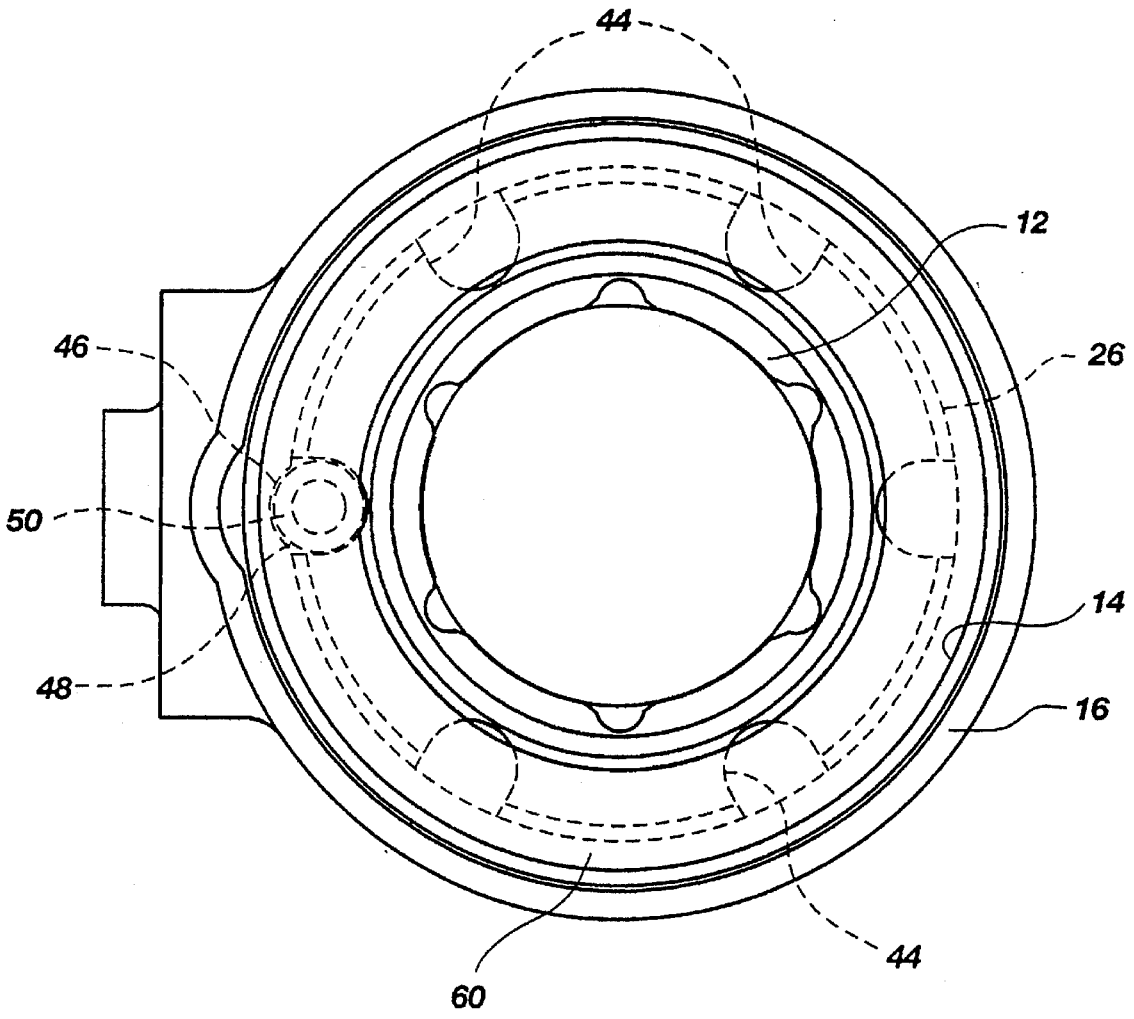
FIG. 3 is an axial view of the end cap assembly of FIG. 1 with a portion of the end cap and the locking button shown with phantom lines.

Referring to FIG. 3, the configuration of the scallops 44 and 46 within the end cap 12 and housing 16 respectively create a locking cavity 48 which of necessity spans the joint 26. When the button 50 is placed within the locking cavity 48, the button 50 overlaps at least a portion of the annular joint 26 thereby preventing the pieces defining the joint 26, namely the end cap 12 and the housing 16, from rotating with respect to each other. Thus, the end cap 12 cannot vibrate loose or inadvertently become unscrewed from the housing 16 under conditions of normal wear and tear.

One of skill in the art will appreciate that the number and spacing of the end cap scallops 44 may vary and that there may be more than one housing scallop 46 within the housing 16. Of importance is that a locking cavity 48 is capable of being formed by aligning an end cap scallop 44 with a housing scallop 46 when the end cap 12 is positioned within the housing 16. Additionally, one of skill in the art will appreciate that the shape of the locking cavity 48 and the button 50 need not necessarily be cylindrical to practice the present invention. The cylindrical shape of the locking cavity 48 and button 50, however, make insertion of the button 50 into the locking cavity 48 orientation independent, and thus, easier. There are other ways to configure a mechanical lock which are known in the art.

Referring to FIG. 1, the end cap assembly 10 of the presently preferred embodiment includes a cover plate 60 which may be positioned to cover the joint 26 between the end cap 12 and the housing 16. The cover plate 60 protects the housing 16 against deformation and prevents the housing 16 from peening over the end cap 12. The cover plate 60 also protects the joint 26 against corrosive particles or other contaminants which may otherwise enter into and damage the joint 26. These foreign particles may interfere with the engagement of the end cap 12 with the housing 16 making end cap 12 removal more difficult and possibly compromising the integrity of the joint 26.

The cover plate 60 is annular, having a interior perimeter 58. The cover plate 60 is also substantially planar. As can be seen in FIG. 2, the end cap 12 of the preferred embodiment is configured with a neck 66. In an assembled state, the cover plate 60 is positioned about the neck 66 of the end cap 12. The interior perimeter 58 of the cover plate 60 substantially conforms to an outer perimeter of the neck 66. The neck 66 prevents transverse movement of the cover plate 60 with respect to the end cap 12, and thus the joint 26. In other words, the neck 66 prevents the cover plate 60 from shifting from side to side with respect to the end cap 12. Such transverse movement could leave the housing 16 adjacent the joint 26 and/or the joint 26 itself exposed to potential damage. Thus, the neck 66 assists in maintaining the cover plate 60 aligned with, and over, the joint 26.

Referring to FIGS. 2 and 3, the cover plate 60 maintains the button 50 within the locking cavity 48 when the cover plate 60 is positioned over the joint 26 between the end cap 12 and the housing 16 and when the split ring 72 is affixed within the external notch 74 of the neck 66.

Referring to FIG. 1, the end cap 12 has an annular top surface 68 and the housing 16 has an annular top surface 70. The end cap 12 and housing 16 are configured such that when the end cap 12 is positioned within the housing 16, the top surface 68 of the end cap 12 and the top surface 70 of the housing 16 are substantially flush with each other. This configuration provides a substantially flat surface upon which the cover plate 60 rests when the cover plate 60 is positioned over the joint 26.

It will be appreciated that the six equally spaced end cap scallops 44 configured within the end cap 12 of the preferred embodiment ensures alignment of one end cap scallop 44 with the housing scallop 46 by rotation of the end cap 12 no more than one sixth of a turn within the housing 16. This allows the top surface 68 of the end cap 12 to be positioned at a predetermined height with respect to the top surface 70 of the housing 16, within a limited range. It will be appreciated by those of skill in the art that when the top surface 68 of the end cap 12 is configured at or below the top surface 70 of the housing 16, the cover plate 60 will prevent the joint 26 from being exposed.

It will further be appreciated by those of skill in the art that the cover plate 60 can be configured in a variety of ways to protect the joint 26 and the housing 16 adjacent the joint 26. Alternative embodiments depend in large part on the configuration of the end cap 12 and the housing 16, and how the end cap 12 is positioned within, or attached to, the housing 16.

The present invention further includes retention means for maintaining the cover plate 60 positioned over the joint 26.

As illustrated in FIGS. 1 and 2, the retention means preferably comprises a retention ring, which in this preferred embodiment is configured as a split ring 72. The retention means also includes an external notch 74 (FIG. 2) configured within the neck 66 of the end cap 12. The split ring 72 can be removably secured within the external notch 74. The external notch 74 is positioned relative to the neck 66 such that the external notch is adjacent the cover plate 60 when the end cap 12 is positioned completely within the housing 16 and the cover plate 60 is positioned about the neck 66.

Referring again to FIG. 2, the external notch 74 is configured to received a portion of the split ring 72. The remainder of the split ring 72 extends beyond the external notch 74, forming a flange 76 which may engage the cover plate 60 and assist in maintaining the cover plate 60 in substantial engagement with the top surfaces 68 and 70 of the end cap 12 and housing 16 on either side of the joint 26. Thus, the split ring 72 prevents axial movement of the cover plate 60 with respect to the end cap 12 and the joint 26. In other words, the split ring 72 prevents the cover plate 60 from sliding up the neck 66 of the end cap 12 away from the joint 26 and housing 16 adjacent the joint 26, which could expose the joint 26 and the housing 16 to potential damage. Thus, the combination of the neck 66 and split ring 72 prevent the cover plate 60 from both axial and transverse movement and thereby maintain the cover plate 60 in position over the joint 26.

The split ring 72 configuration allows for easy removal of the retention means from the end cap 12. Thus, the button 50 is easily accessible by removing the cover plate 60. Accordingly, the locking means is conveniently accessed and easily removed. Further, the locking means is protected by the cover plate 60, thereby preventing potential damage to the locking means which in turn could hinder or prevent the removal of the end cap 12 from the housing 16.

Referring to FIG. 2, the end cap assembly 10 includes an annular channel 28 configured within the end cap 12. The annular channel 28 is configured to receive and retain an O-ring 30 such that a seal is formed between the end cap 12 and the chamber 14 when the end cap 12 is positioned within the housing 16. This configuration substantially prevents the pneumatic or hydraulic pressure within the chamber 16 from escaping through the joint 26. The O-ring 30 of the present invention may include any of those commercially available 0rings known for such use.

In a presently preferred embodiment, the cover plate 60, end cap 12, and housing 16 are all made of steel. One of skill in the art will appreciate that the cover plate 60, end cap 12, and housing 16 are the components of the end cap assembly 10 which define and cover the joint 26. The heat treatment of the steel in these components provides added strength and protection to the joint 26 and reduces the likelihood of damage to the joint 26. The housing 16 of the preferred embodiment is forged, adding yet another measure of strength to the end cap assembly 10.

As illustrated in FIG. 1, the end cap assembly 10 is assembled by screwing the end cap 12 into the housing 16 as far as allowed by the corresponding threads 24, i.e., until the end cap 12 "bottoms out." The end cap 12 may be screwed into the housing 16 by hand, with the driver 36, or with another device. The end cap 12 is then turned until one of the end cap scallops 44 configured within the end cap 12 aligns with the housing scallop 46 of the housing 16. This alignment forms the locking cavity 48. The button 50 is then placed within the locking cavity 48 using the beveled edge 51 of the button 50 to facilitate insertion.

With the button 50 in place, the cover plate 60 is positioned about the neck 66 of the end cap 12 and over the joint 26 and button 50. The split ring 72 is then placed about the neck 66 and within the external notch 74, thereby securing the cover plate 60 over the joint 26.

To remove the end cap 12 from the housing 16, the split ring 72 is removed from the notch 74 and the split ring 72 and cover plate 60 are removed. The button 50 is then removed. It may be necessary to apply friction to the inside of the tapped hole 52 of the button 50 in order to grasp the button 50 and remove it.

Removal of the end cap 12 from the housing 16 requires insertion of the driver 36 into the countersink 34 and the application of a torque to the driver 36. If, through normal wear and tear, the shape of the countersink 34 is no longer substantially the same as the shape of the driver 36, the driver 36 can be machined or otherwise sized to fit within the countersink 34. Once the driver 36 is positioned within the countersink 34, a wrench or other torque applying tool can be applied to the attachment segment 40 of the driver 36. The end cap 12 is then unscrewed from the housing 16. It is advisable to make sure that there is no pressure within the chamber 14 of the housing 16 before removing the end cap 12.

Many of the problems associated with conventional end cap assemblies for hydraulic or pneumatic faster installation devices are addressed by the teachings of the present invention. The end cap assembly 10 disclosed herein provides protection for the portion of the housing 16 where the end cap 12 is inserted into the housing 16 and also for the joint 26 between the end cap 12 and the housing 16. The present invention also provides a reliable means for removing the end cap 12 even if the housing 16 is deformed or the joint 26 is in some way damaged. Finally, the present invention provides an end cap assembly 10 with a protected locking means for securing the end cap 12 to the fastener installation tool 18 which can be conveniently accessed and removed.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An end cap assembly for sealing a housing of a fastener installation tool, the housing including a threaded internal surface, comprising:

an end cap configured with a threaded exterior surface for threadable engagement with the threaded internal surface of the housing thereby forming a joint between the end cap and the housing;

means configured within the end cap for engaging the end cap to thereby permit the application of a torque to the end cap;

a cover plate configured to cover the joint between the end cap and the housing; and retention means for maintaining the cover plate in position.

2. The end cap assembly of claim 1, further comprising locking means for preventing rotational movement of the end cap relative to the housing.

3. The end cap assembly of claim 2, wherein the locking means comprises at least one end cap scallop configured within the end cap and at least one housing scallop configured within the housing, at least one end cap scallop and at least one housing scallop being capable of alignment with each other when the end cap is positioned within the housing to thereby form a locking cavity, and wherein the locking means further comprises a button configured to fit within the locking cavity thereby preventing rotational movement of the end cap relative to the housing.

4. The end cap assembly of claim 3, wherein the cover plate may be positioned over the locking cavity to thereby maintain the button within the locking cavity.

5. The end cap assembly of claim 1, wherein the cover plate is substantially planar.

6. The end cap assembly of claim 1, wherein the end cap further comprises a neck having an outer perimeter.

7. The end cap assembly of claim 6, wherein the cover plate comprises an annular disc positionable about the neck to thereby prevent transverse movement of the cover plate relative to the end cap.

8. The end cap assembly of claim 6, wherein the retention means comprises a notch configured in the neck of the end cap and a split ring positionable within the notch to thereby prevent substantial axial movement of the cover plate with respect to the end cap.

9. The end cap assembly of claim 1, wherein the means for removing the end cap from the housing comprises a countersink configured in the end cap and a driver configured to securely engage the countersink to thereby permit the application of a torque on the driver to be transferred to the end cap.

10. The end cap assembly of claim 9, wherein the countersink and the driver have a corresponding hexagonal configuration.

11. An end cap assembly for sealing a housing of a fastener installation tool, the housing including a threaded internal surface, comprising:

an end cap configured with a threaded exterior surface for threadable engagement with the threaded internal surface of the housing thereby forming a joint between the end cap and the housing, the end cap comprising a neck having an outer perimeter and a notch being configured within the outer perimeter of the neck;

a countersink configured within the end cap;

locking means for preventing rotational movement of the end cap relative to the housing when the end cap is positioned within the housing;

an annular cover plate positionable about the neck to cover the joint between the end cap and the housing, the neck configured to prevent the cover plate from transverse movement relative to the end cap; and a split ring positionable within the notch of the end cap to thereby prevent substantial axial movement of the cover plate.

12. The end cap assembly of claim 11, wherein a driver is configured to securely engage the countersink to thereby permit the application of a torque on the driver to be transferred to the end cap.

13. The end cap assembly of claim 12, wherein the driver has a first end and a second end, the first end and the second end each configured with a bevelled edge to facilitate insertion of the driver into the countersink.

14. The end cap assembly of claim 12, wherein the driver includes an attachment segment which extends beyond the countersink when the driver is positioned within the countersink to thereby permit a tool to be positioned about the attachment segment and allowing a torque on the driver to transfer to the end cap.

15. The end cap assembly of claim 11, wherein the locking means comprises at least one end cap scallop configured within the end cap and at least one housing scallop configured within the housing, at least one end cap scallop and at least one housing scallop being capable of alignment with each other when the end cap is positioned within the housing to thereby form a locking cavity, and wherein the locking means further comprises a button configured to fit within the locking cavity thereby preventing rotational movement of the end cap relative to the housing.

16. The end cap assembly of claim 15, wherein the locking means comprises six end cap scallops equally spaced about the end cap.

17. The end cap assembly of claim 15, wherein the button is configured with an internally tapped hole to thereby facilitate removal of the button from the locking cavity.

18. The end cap assembly of claim 15, wherein the locking cavity and button are substantially cylindrical.

19. The end cap assembly of claim 15, wherein the cover plate is positioned over the locking cavity to thereby maintain the button within the locking cavity.

20. An end cap assembly for sealing a housing of a fastener installation tool, the housing including a threaded internal surface, comprising:

an end cap configured with a threaded exterior surface for threadable engagement with the threaded internal surface of the housing thereby forming a joint between the end cap and the housing, the end cap further configured with a neck having an outer perimeter and a notch being configured within the outer perimeter of the neck;

a countersink configured within the end cap to receive a driver;

a plurality of end cap scallops equally spaced about the end cap;

a housing scallop configured within the housing, one of the end cap scallops being capable of alignment with the housing scallop when the end cap is positioned for locking within the housing, the aligned scallops thereby forming a substantially cylindrical locking cavity;

a cylindrical button configured to securely fit within the locking cavity thereby preventing rotational movement of the end cap relative to the housing, the button being configured with an internally tapped hole to facilitate removal of the button from the locking cavity;

an annular cover plate positionable about the neck of the end cap to cover the joint between the end cap and the housing and to cover the locking cavity and maintain the button within the locking cavity, the neck preventing the cover plate from transverse movement relative to the end cap; and a split ring which may be removably positioned within the notch of the neck of the end cap to thereby prevent substantial axial movement of the cover plate with respect to the end cap.

* * * * *